United States Patent [19]

Gostelow

[11] 4,193,274

[45] Mar. 18, 1980

[54] YARN FEED AND CHANGE MECHANISMS

[75] Inventor: Daniel W. F. Gostelow, Leicester, England

[73] Assignee: Wildt Mellor Bromley Limited, Leicester, England

[21] Appl. No.: 17,901

[22] Filed: Mar. 6, 1979

[30] Foreign Application Priority Data

Mar. 17, 1978 [GB] United Kingdom ..... 10611/78

[51] Int. Cl.[2] ..... D04B 15/54

[52] U.S. Cl. ..... 66/140 R

[58] Field of Search ..... 66/125 R, 140 R, 140 S, 66/141, 142, 143, 145 S

[56] References Cited

U.S. PATENT DOCUMENTS

| | | | |
|---|---|---|---|
| 3,890,809 | 6/1975 | Tenconi | 66/140 R |
| 4,137,732 | 2/1979 | Gostezow | 66/140 R |

FOREIGN PATENT DOCUMENTS

| | | | |
|---|---|---|---|
| 1069813 | 11/1959 | Fed. Rep. of Germany | 66/125 R |
| 926857 | 5/1963 | United Kingdom | 66/125 R |
| 1426094 | 2/1976 | United Kingdom | 66/125 |

*Primary Examiner*—Ronald Feldbaum

*Attorney, Agent, or Firm*—Buell, Blenko & Ziesenheim

[57] ABSTRACT

A yarn feed and change mechanism or striper (FIG. 3) has a plurality of yarn feed passages which can be used alternatively to feed yarn to a knitting machine. Each yarn feed passage is associated with a pneumatic means (22, 24, 84) for propelling a leading end of yarn to knitting needles, with a movable wall portion (34) for engaging and trapping yarn in alignment with the direction of the yarn feed passage, and a separately movable severing member (42) for severing yarn trapped in the passage.

5 Claims, 8 Drawing Figures

YARN FEED AND CHANGE MECHANISMS

DESCRIPTION

Field of Invention

The invention relates to yarn feed and change mechanisms for use in knitting machines, commonly referred to as "stripers". Stripers of the invention may be used on flat bed or circular knitting machines. The stripers are particularly suitable for rotating cylinder circular knitting machines although they may also in principle be used on rotatable cam box type machines having single or double cylinders.

BACKGROUND OF INVENTION

Pneumatic yarn feed devices are described in the British Pat. No. 1,426,094. Such devices require external yarn cutting devices. Other devices having internal yarn cutting and trapping arrangements are described in the West-German Auslegeschrift No. 1,069,813. Such devices required complicated control arrangements to synchronise successive operations during a yarn change. This problem is particularly troublesome when a large number of such devices is arranged around a knitting machine. The time required for a yarn change is long and may differ depending on the particular yarn selected.

It is the object of the invention to provide a striper capable of changing yarns with widely differing characteristics, which is easily controlled and can be used at a plurality of positions around the knitting machine.

It is another object of the invention to provide a striper which is capable of introducing yarn using a small sector of the needle circle.

The Italian Pat. No. 597,024 describes a device wherein a cutting blade projects across the path of yarn to first cut and then trap the yarn.

The British Patent Application No. 38792/76 describes a pneumatic striper for meeting the object of the invention. The present invention relates to an alternative form of construction which employs some features already in the British Patent Application No. 38792/76.

SUMMARY OF INVENTION

The invention provides a striper including a plurality of yarn feed passages and means for providing a flow of fluid through the passages to propel a leading yarn end towards knitting needles, the striper being adapted to sever and trap yarn in a particular one of the passages by means of a movable passage wall portion for trapping yarn in the particular passage and a separately movable member for severing yarn extending out of the particular passage toward the knitting needles. As soon as the movable wall portion is withdrawn and the severing member is moved clear of the passage, the leading end of yarn is aligned with the passage and ready for blasting towards the needles. As a result the propulsion of the leading yarn end is sufficient. Any number of the yarn feed passages may have the provisions for trapping and severing outlined above.

Each yarn feed passage may be formed by a tube extending into a plenum chamber defining an initial, upstream passage part and a subsequent downstream collapsible part defined on one side by the movable passage wall portion, and the means for providing a fluid flow may be an inlet for compressed fluid leading into the plenum chamber for creating suction inside the tube by a Venturi-effect and propelling or blowing fluid through the tube and subsequent passage part to atmosphere. The Venturi-effect is conveniently created at a position adjacent the collapsible passage part so that the compressed fluid used for creating suction is immediately thereafter expelled through the collapsible passage part. This arrangement promotes the efficient propulsion of leading yarn ends.

Preferably the severing member is arranged to cut yarn by cooperating with an edge formed at the downstream end of the passage to slice through the yarn. Advantageously the edge is formed by a substantially stationary passage wall portion of a stationary member which wall portion serves to cooperate with the movable passage wall portion to trap the yarn. Thus the overall passage is short and the pressurized fluid, such as compressed air, is used effectively to propel the yarn. In use the striper may be associated with a latch guard having an aperture for receiving leading yarn ends from the different passages and guiding them to a yarn feed aperture located appropriately in the latchguard. Control of the leading yarn ends can be assisted by providing a flow guide outside the needle circle or a suction device inside the needle circle opposite the yarn feed aperture and passage outlets. Certain needles may be omitted from the needle circle in a so-called bodge zone to provide an unobstructed path for the fluid flow of entrained yarn.

The different parts of the striper concerned with the yarn feeding severing and trapping may be arranged as follows. Preferably the striper has, associated with each yarn feed passage, individual main slidable members each having mounted thereon the severing member and a subsidiary slidable member, also referred to as a trapper, defining the movable passage wall portion, resilient means urging the main slidable member and the trapper apart and abutment faces on the respective slidable members to limit movement of the trapper. Thus abutment faces will hold the movable passage wall portion back to permit yarn feeding in one position of the main slidable member; the resilient means will first cause the wall portion on the trapper to trap the yarn when sliding the main slidable member and then yield to permit the severing member to continue its movement thereafter and to sever the yarn. Preferably the main slidable member is shaped so as to receive the trapper therein. Thus all slidable striper parts for trapping and severing may be compactly located on one side of the yarn feed passages and trap and sever successively in a reliable manner using a single actuating movement of the main slidable member.

Advantageously the stationary member forming the wall portion facing the movable passage wall portion and the edge for cooperating with the severing member, has extensions thereon located alongside the trapper to give a substantially U-shaped member having a central slot for aligning the edge with the severing member. Preferably the stationary member is keyed to a mounting and urged resiliently towards the severing member. The severing operation can be performed reliably and the severing member itself can be rigid so as to resist displacement in the direction of yarn movement when cutting through the yarn.

The actuation of the striper can be arranged in the following manner. Preferably resilient means are provided to urge the main slidable member into a feeding position permitting the feeding of yarn through the passage and an operating slide is provided movable transversely to the main slidable element and having a camming face for shifting the main slidable member away from the feeding position to trap and sever the yarn. The camming face may be arranged so that there is no shifting of the main slidable member at the beginning and end of the operating slide movement. The operating slide may be connected to a yarn storage and guide lever so as to pivot it to draw a store yarn when trapping and severing yarn and pivot back to release this yarn store when commencing yarn feeding. The operating slide permits the yarn guide lever and slidable members to be arranged compactly above one another. The length of yarn drawn by the guide arm may be varied by providing a number of alternative guide hole positions above the guide arm.

Suitably the operating slides are selectively operable by piston and cylinder devices arranged to act in the same direction as the operating slide and preferably arranged parallel to the operating slide and behind it. The pistons can then engage projections on the operating slides.

Preferably the cylinders are arranged side by side in pairs. Where four or more operating slides are used, one pair may be behind another. Conveniently, pistons are provided for shifting of the operating slide in either direction and the cylinders containing the pistons for moving the main slidable member to the yarn feeding position each have an outlet for communicating with an appropriate one of the plenum chambers to create a flow of fluid through the associated passage. Advantageously the pistons for moving the main slidable members to the yarn feeding position are selectively operated and the oppositely acting pistons for cutting and trapping are operated by a common fluid supply, the return of the previously selectively operated piston being avoided by maintaining the supply of compressed fluid to its cylinder.

DRAWINGS

DESCRIPTION OF PREFERRED FORM OF THE INVENTION

Figure 1:
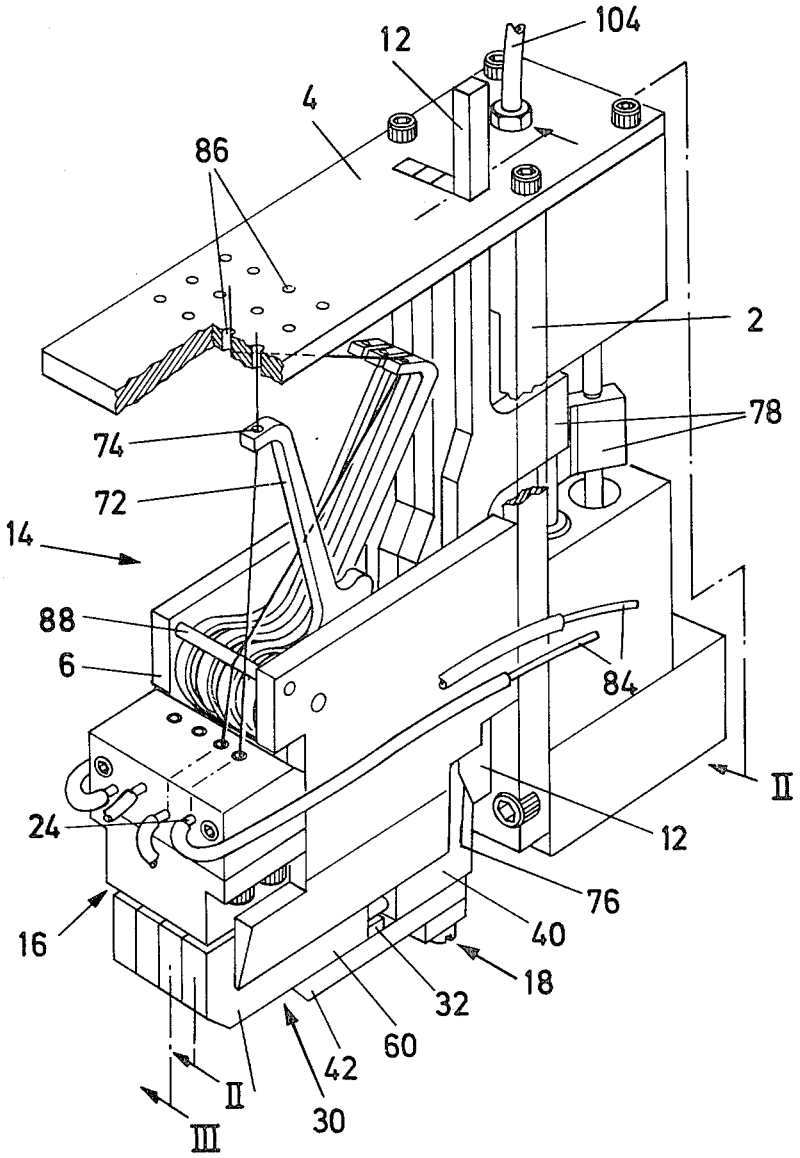
FIG. 1 is a perspective view of a preferred form of a yarn changing unit or striper according to the invention.

With reference to the Figures, a striper has a mounting frame consisting of a back plate 2, a top plate 4, and a plate assembly with an H-section 6 at the front of the back plate 2. The frame mounts a top piston and cylinder block 8 under the top plate 4 at the rear of the back plate 2; a bottom piston and cylinder block 10 at the rear of the back plate 2 but below the block 8; a number of operating slides 12 held alongside the back plate 2 in a recess in the top plate 4 and the assembly 6; a yarn guide and storage arrangement 14 at the front of the back plate 2; and below it a yarn feeding, trapping and severing arrangement incorporating a stationary assembly 16 at the front of the striper below the arrangement 14 and an actuating assembly 18 between the assembly 16 and the slides 12.

The striper is adapted to control four yarns. Each yarn is controlled by one set of a group comprising four similar sets of components. The description which follows relates to one such set but applies equally to the other sets.

The yarn is fed through a yarn feed passage which has an initial, upper part formed by a tube 20 projecting through a plenum chamber 22 formed in a chamber housing of the stationary assembly 16. Compressed air can be introduced through an inlet 24 into the chamber 22. The air leaves the chamber 22 through an annular gap 25 formed between a lower end 28 of the tube 20 and an outlet orifice 26 from the chamber 22. The yarn feed passage has a collapsible lower part 30 defined on one side by a wall portion 34 of a slidable plate-like trapper 32 and on the other sides by wall portions on either side of a central slot 35 in a stationary member 36 of the assembly 16. When the wall portions 34 and 38 move against one another, the yarn is trapped. The yarn is cut by a cutter blade 42 exchangeably mounted on a slidable member 40 of the actuating assembly 18. The trapper 32 is mounted in the actuating assembly 18 between the member 40 and the cutter blade 42. An edge of the blade 42 engages a lower edge 44 of the wall portion 38 for cutting the yarn.

The actuating assembly 18 includes a spring 50 retained in the trapper 32 by a bore in the trapper 32 and a guide pin on the slidable member 40. The spring 50 urges the trapper apart from the slidable member 40 to the extent permitted by an abutment face 52 on the member 40 or the stationary wall portion 38. There is further a spring 56 retained by a projecting flange 54 on the chamber housing of the stationary assembly 16 and a slot 58 in the slidable member 40. This spring 56 urges the slidable member 40 apart from the assembly 16 and into engagement with the slide 12. The spring 56 is received partly inside the flange 54. The stationary member 36 has extensions 60 located on each side of the trapper 32 between the member 40 and the cutter blade 42 and is retained in a fixed position with respect to the chamber housing by a lug 62. The member 36 is sprung downward by a spring 64 to urge the edge 44 towards the cutter blade 42.

The different slidable members 40, trappers 32 and stationary members 36 are retained side by side by downwardly extending wall portions of the plate assembly 6. The spring 56 is stronger than the spring 50.

Figure 4:
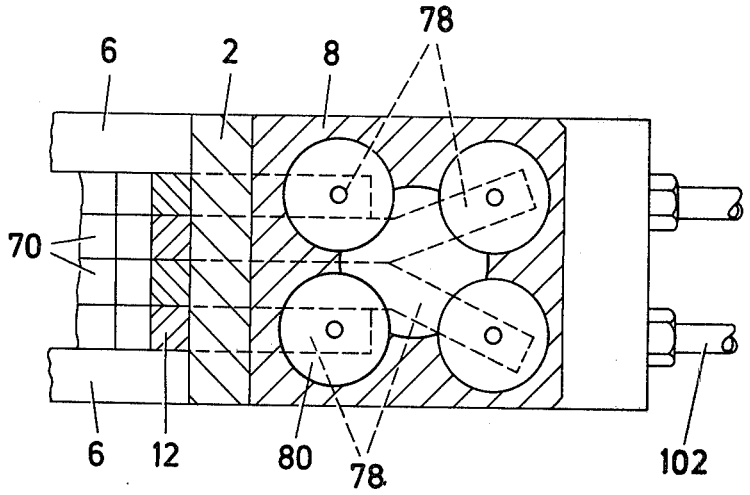
FIG. 4 is a section on line IV—IV of FIG. 3.

The operating slide 12 has a projection 70 at the front engaging a pivotable yarn storage arm 72 with a yarn guide eye 74 at its end. The slide 12 has a sloped cam face 76 engaging the member 40. At the rear the slide has a projection 78 engaged by pistons 80 and 82 in the upper and lower blocks 8 and 10 respectively. Passages 84 connect the lower cylinders individually to appropriate plenum chambers 22. The different projections 78 are arranged side-by-side as shown in FIG. 4.

The yarn can be threaded through one of three guide holes 86 provided for that particular yarn in the top plate, through the eye 74, over a smooth guide bar 88 and through the appropriate yarn feed passage.

Figure 5:
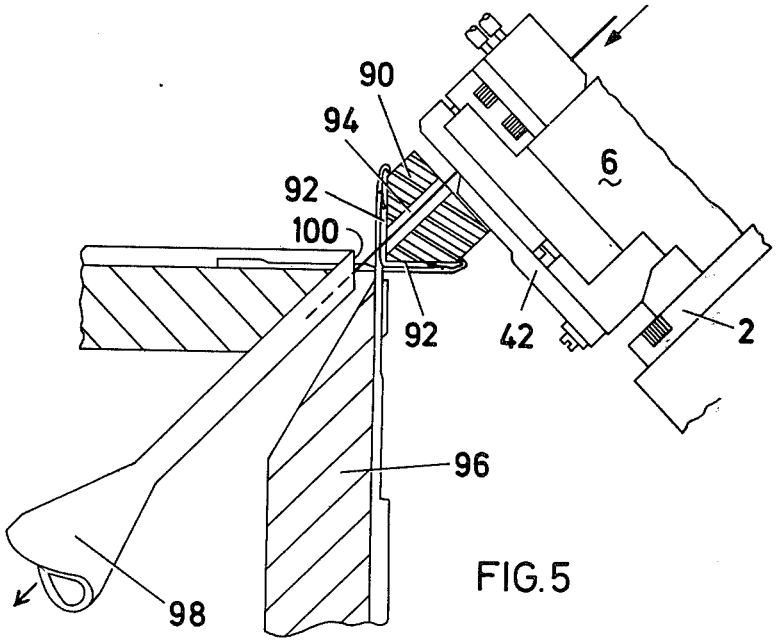
FIG. 5 is a view section through a cylinder and dial machine showing a suction nozzle, situated within a needle cylinder below a dial and a latchguard in cooperating relationship with the striper of FIG. 1.
Figure 6:
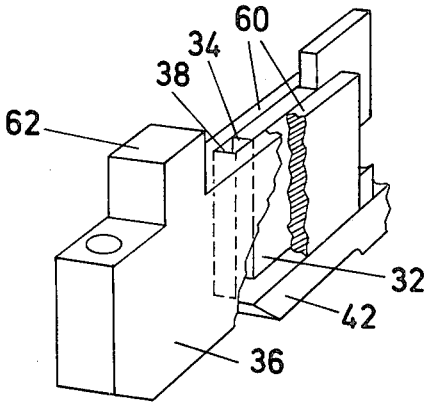
FIG. 6 is an enlarged perspective view of part of the striper of FIG. 1.

The stripper can be fixed to a cylinder and dial circular knitting machine in the attitude shown in FIG. 5 to provide a 45° angle of the yarn feed passage to the vertical. As a result of such a mounting attitude, the operation of the needles remains observable. Downstream of the stripper, a latchguard 90 is provided on the knitting machine having the usual latchguarding surfaces 92 but having a slot 94 arranged so that the mouth of the slot faces the respective yarn feed passages of the stripper on the side closest to the striper. However the slot 94 has a narrow mouth at the other side remote from the striper and the slot converges to define a small yarn feeding aperture adjacent a needle cylinder 96 of the knitting machine. A suction nozzle 98 having a vertically elongated aperture 100 may be mounted inside the needle cylinder 96 in alignment with the slot 94 and yarn feed passage direction. The needles may be arranged around the entire periphery, except for a small part called a bodge section where needles are removed from the cylinder to provide a clear, unobstructed path for air from the yarn feed passages, through the slot 94 to the nozzle 98 and entrain yarn radially past the needles, placing the yarn in the path of the leading needles.

Figure 2:
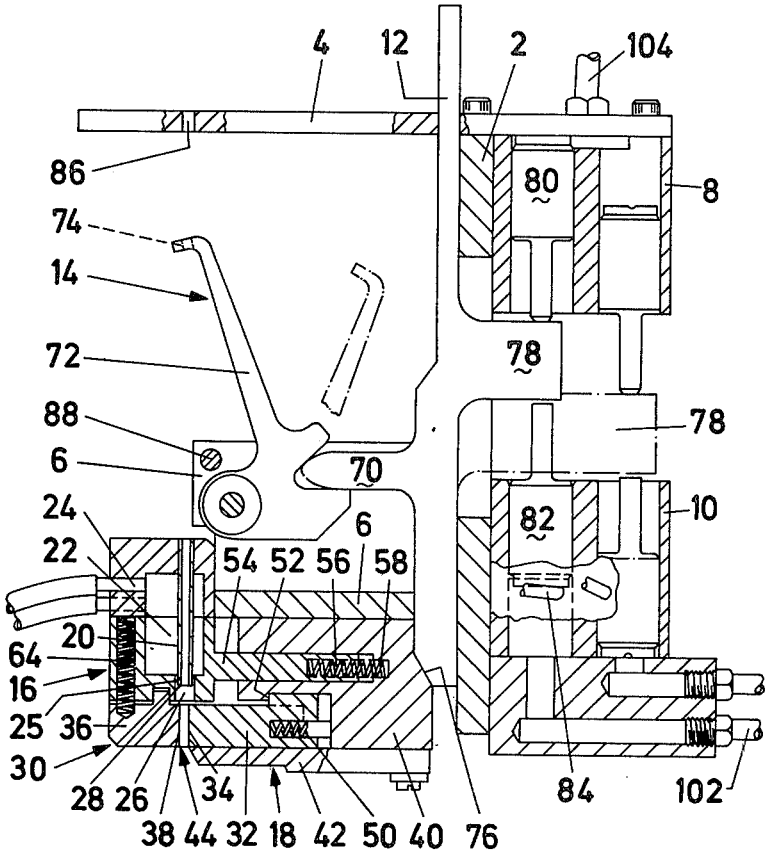
FIG. 2 is a section on line II—II of FIG. 1 showing the striper in a yarn feeding position.

In use on a knitting machine, the striper will operate as follows. Starting from a trapping position shown in FIG. 3 with the yarn stationary, the striper can move to a feed position shown in FIG. 2 to introduce a yarn. Compressed air is supplied through an inlet tube 102 selected in a manner the same as that described in the British Pat. No. 38972/76 to a cylinder to raise a piston 82 engaging the appropriate projection 78 and hence lift the slide 12.

Initially, the cam face 76 passes over a straight rear edge of the member 40 so that only the yarn storage arm 72 is pivoted to release yarn. Next, the cam face 76 reaches a sloped part at the rear of the member so that the member 40 moves backwards under the bias of the spring 56. The cutter blade 42 is consequently retracted and uncovers the lower end of the collapsible yarn feed passage. Subsequently the abutment face 52 pulls the trapper 32 away from the stationary member 36 against the pressure exerted by the spring 50 and so opens the passage part 30. At this subsequent stage, the cam face 76 has nearly moved past the sloped part of the member 40 and the piston 82 moves to uncover a small outlet connected to one end of a tube 84, the other end of which is connected to the inlet 24 to one of the plenum chambers 22. Thus as the lower passage part 30 opens, a flow of compressed air is directed down this part 30. The movement of air through the annular gap creates suction in the upper passage part 20 so that a flow of air is created along the length of the passage increasing in velocity towards the lower end. The untrapping of the leading yarn end, the release of yarn stored by the arm 72 and the blast of air, as described previously, causes the leading end of yarn to be ejected from the striper into the slot 94 of the latchguard 90. The nozzle 98 is activated so that the leading end of yarn is propelled through the latchguard 90 across the needle cylinder 96 through the bodge section into the nozzle 98. The leading end of yarn will thus be knitted by the subsequent needles.

In order to cut and trap any yarn either to terminate knitting or to effect a yarn change, compressed air is supplied to an inlet 104 connected to all the cylinders in the top block 8. The air is introduced just after any new yarn has been introduced as described. The supply of air to the tube 102 is continued for the yarn previously introduced to counteract the pressure exerted by the piston 80 in the top block 8. The supply of air is cut off from both blocks 8 and 10 at the same time.

Figure 3:
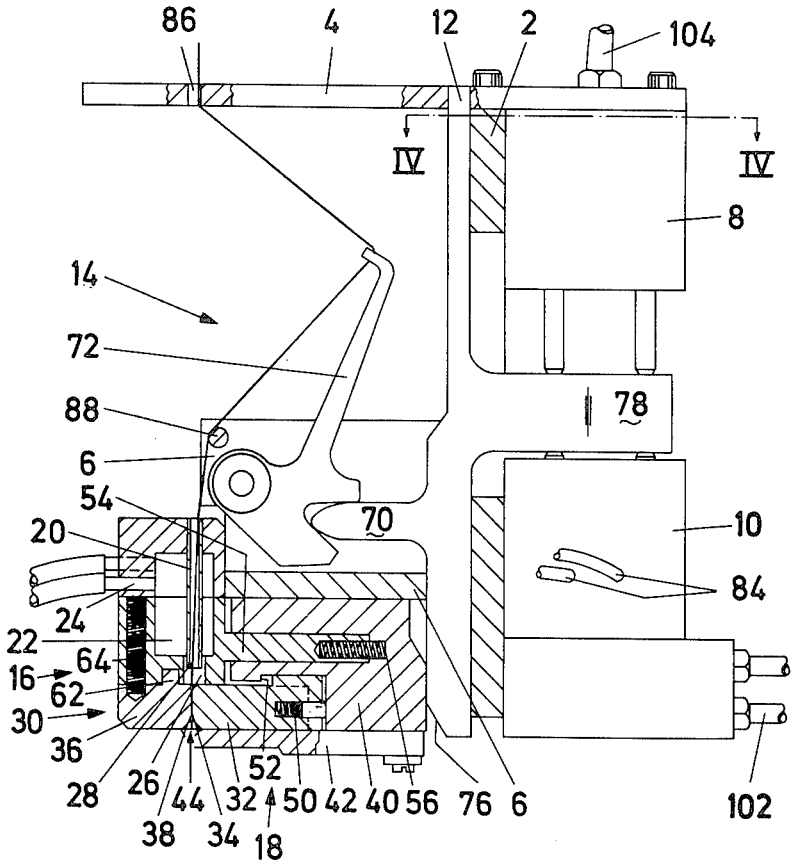
FIG. 3 is a part section on line III—III of FIG. 1 showing the striper in a yarn trapping position with the yarn severed.

Any pistons 80, which are in an upward position and not associated with the parts by means of which yarn has been introduced, are thus displaced downwards returning their slide 12 to the position shown in FIG. 3. The sequence of events previously described thus takes place in reverse: the trapper 32 engages the stationary wall portion 38; the cutter blade 42 cuts the yarn in cooperation with the edge 44; and the yarn storage arm is pivoted back to draw more yarn. As the cutter blade 42 progresses it gradually closes the clearance between the stationary member 36 and the plenum chamber housing against the pressure of the spring 64 (See FIG. 3).

The striper can feed more than one yarn simultaneously. The member 40 can be manually operated for threading up. The compressed air is used effectively and the leading ends of yarn are not kinked or displaced out of the yarn feed passage during trapping. Different types of yarn can be employed using an appropriate guide hole 86 in the top plate 4. The yarn emerges adjacent a corner of the striper thus permitting it to be mounted close to the needle cylinder. The cutting and trapping zones are closely adjacent.

Figure 7:
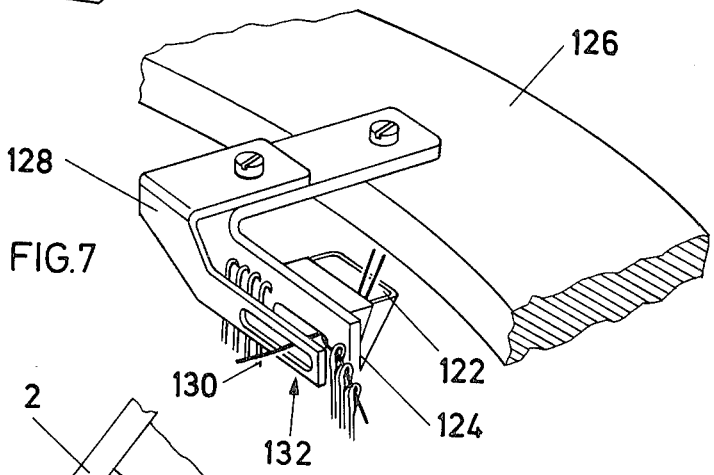
FIG. 7 is a perspective view showing a yarn guide arrangement for cooperating with the striper of FIG. 1 on a single cylinder machine.
Figure 8:
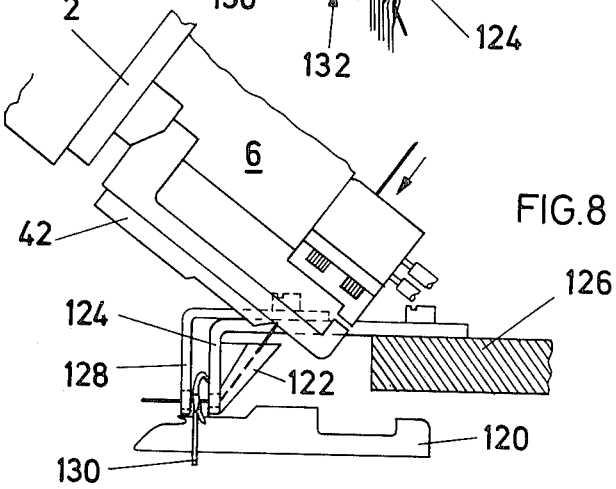
FIG. 8 is a side view of the arrangement of FIG. 7 with the striper in position.

With reference to FIGS. 7 and 8, the striper can be fixed to a single cylinder machine with an outside ring of sinkers 120 in the attitude shown in FIG. 8. To guide the leading ends of yarn, a guide trough 122 is provided to a combined latchguard/yarn feeder 124 mounted on a ring 126. A yarn guide 128 is provided at the rear of the needles to ensure that the leading end is wrapped properly around the leading needle 130 after the passing of the bodge zone devoid of needles indicated at 132.

I claim:

1. Striper for knitting machine including:

a plurality of yarn feed passages; pneumatic means for providing a flow of fluid through the passages to thereby propel a leading yarn end towards knitting needles of the knitting machine; and, associated with the respective yarn feed passages;

a movable yarn feed passage wall portion for the respective yarn feed passage and a wall portion facing the movable yarn feed passage wall portion; drive means for moving movable wall portion against the facing wall portion to thereby trap yarn and hold it in alignment with the passage direction; and a member movable independently of the movable wall portion for severing yarn held in the passage.

2. Striper as claimed in claim 1 wherein there is provided associated with the respective yarn feed passages a fixed cross-section passage part mounted upstream in the direction of fluid flow from the respective movable and facing wall portions and a space surrounding an outlet of the respective fixed cross-section passage parts to create suction therein and blow fluid between the movable and facing wall portions.

3. Striper for knitting machne including:

a plurality of yarn feed passages each having an upstream fixed cross-section part and a downstream part defined by a movable wall portion and a wall portion facing the portion; a space surrounding an outlet of each of the upstream parts, means for supplying fluid under pressure to a selected one of said spaces to create suction in the associated upstream part and blow fluid through the associated downstream part to thereby propel a leading yarn end towards knitting needles of the knitting machine;

a severing member movable independently of the movable wall portion for each of the yarn feed passages;

drive means associated with each of the yarn feed passages comprising a slidable member fixedly mounting the severing means and resiliently mounting the movable wall portion to permit its displacement relative to the severing member in the direction of sliding movement so that on operating the appropriate slidable member yarn is trapped in the downstream part and is subsequently severed as the severing member moves across the yarn feed passage.

4. Striper as claimed in claim 3 wherein a U-shaped member forms the facing wall portion and resilient means bias the U-shaped member against the severing means and a plate-like member is slidable fitted in a central slot of the U-shaped member and forms the movable wall portion.

5. Striper as claimed in claim 3 wherein an operating member is in camming engagement with the slidable member and has a first projection and a second projection, piston and cylinder devices engage the first projection to move the operating member and thereby the slidable member and a pivotable yarn storage arm engages the second projection to draw a store of yarn as the slidable member is operated to trap and cut yarn.

* * * * *

UNITED STATES PATENT AND TRADEMARK OFFICE

CERTIFICATE OF CORRECTION

PATENT NO. : 4,193,274

DATED : March 18, 1980

INVENTOR(S) : DANIEL W. F. GOSTELOW

It is certified that error appears in the above-identified patent and that said Letters Patent are hereby corrected as shown below:

Column 1, line 58, "sufficient" should read --efficient--.

Claim 3, column 6, line 62, "machne" should read --machine--.

Claim 3, column 6, line 66, after "facing", "the" should read --that--.

Signed and Sealed this

*Twenty-second* Day of *July 1980*

[SEAL]

*Attest:*

SIDNEY A. DIAMOND

*Attesting Officer*

*Commissioner of Patents and Trademarks*